US005216764A

United States Patent [19]

Hall et al.

[11] Patent Number: 5,216,764

[45] Date of Patent: Jun. 8, 1993

[54] DISPOSABLE BATHTUB AND SHOWER LINER

[76] Inventors: Horace Hall, Vivian E. Lacy, both of P.O. Box 112702, Carrollton, Tex. 75011-2702

[21] Appl. No.: 750,241

[22] Filed: Aug. 27, 1991

[51] Int. Cl.[5] ..... A47K 3/02

[52] U.S. Cl. ..... 4/583; 4/244.3; 4/DIG. 18

[58] Field of Search ..... 4/580-583, 4/244.3, DIG. 18

[56] References Cited

U.S. PATENT DOCUMENTS

| | | | |
|---|---|---|---|
| 1,987,020 | 1/1935 | Looft | 4/DIG. 18 X |
| 2,264,672 | 12/1941 | Levine | 4/580 |
| 3,045,254 | 7/1962 | Cook et al. | 4/580 |
| 3,348,243 | 10/1967 | Kelly | 4/244.3 |
| 3,579,669 | 5/1971 | Loewenstein | 4/244.3 |
| 3,931,651 | 1/1976 | Weir | 4/580 |
| 3,938,200 | 2/1976 | Roberts et al. | 4/DIG. 18 X |
| 4,069,523 | 1/1977 | Ridgeway | 4/580 |
| 4,106,133 | 8/1978 | Roberts | 4/DIG. 18 X |
| 4,602,393 | 7/1986 | Fireash | 4/580 |
| 4,956,882 | 9/1990 | Cohn | 4/580 |
| 5,003,647 | 4/1991 | Williams | 4/580 X |
| 5,040,252 | 8/1991 | Taggart | 4/580 |

FOREIGN PATENT DOCUMENTS

| | | | |
|---|---|---|---|
| 2642823 | 9/1976 | Fed. Rep. of Germany | 4/580 |
| 2599956 | 12/1987 | France | 4/244.3 |

*Primary Examiner*—Charles E. Phillips

[57] ABSTRACT

A bathtub and shower liner ensemble comprised of thin, flimsy, disposable, sterile, contoured, impervious, plastic film sheers, with a bottom mat-like sheet secured to bathtub or shower basin to provide cushion and comfort. The entire liner assembly is compressed to form a single, thin, flexible, chaise lining, which is contoured to fit removably into the bathtub on the bottom, sides, ends, and top surfaces. The chaise-liner is removed through the process of peeling, where thin, film sheers, are individually peeled from the top, until the bottom mat-like sheet is peeled off the tub surface. This removal process, strips away all accumulated dirt and bacteria, and introduces a new, sterile surface. Conventional time and effort required to clean and sterilize are virtually eliminated. Each disposable, film sheer is water-tight and non-toxic, which serves as protection against the transmission of disease or infection. This combination of liner features introduces the invention to common households, motels, hotels, retirement homes, public spas, and health-care institutions.

1 Claim, 5 Drawing Sheets

DISPOSABLE BATHTUB AND SHOWER LINER

FIELD OF THE INVENTION

This invention relates to the field of bath tub liners and more specifically to an improved disposable liner for both the bath tub and shower.

BACKGROUND OF THE INVENTION (PRIOR ART)

Heretofore, disposable bathtub and shower liners have been well known in the art. In general, they commonly involve non-slip floor mats affixed in place by suction cups, as shown in U.S. Pat. Nos. 1,759,348 and 2,264,672 and 2,495,602. Cushioned mats provided a protective liner comprising of a number pads adapted to cover the sides and bottom of the tub. These pads were limited in their use as a disposable and protective barrier between water and bathtub.

In U.S. Pat. No. 4,956,882 padded panels with support means provided additional mobility assistance for the young and elderly. The limited number of padded panels allow contamination of bathtub and liner requiring cleaning and sterilization after each use. Weir discloses in U.S. Pat. No. 3,931,651 a thin flexible liner held in place with a magnetic flange. This removable liner has no bottom leaving bath tub exposed to dirt and bacteria, requiring cleaning of both liner and bathtub.

U.S. Pat. No. 3,045,254 combines an impervious plastic layer and inner layer of supporting compressible material to provide comfort. This semi-flexible liner is secured in place restricting disposability with cleaning being required. U.S. Pat. Nos. 4,069,523 and 4,602,393 discuss an integral sheet of plastic material shaped to conform to the bottom , sides, vertical one end and sloping other end of bathtub, which extend above the upper edges of the bathtub. The flexible and reusable character of this liner prohibits disposal which increases the cleaning effort to include both liner and bathtub.

U.S. Pat. Nos. 3,938,200 and 4,106,133 teach the advent of biologically clean plastic films for lining a bathtub to establish a physical barrier between bath and patient. The thin, flimsy, plastic liner provides a low cost contamination prevention system obviating the need to clean and sterilize the bathtub and shower after each use. Installation requires spaced apart hooks be placed into bathroom wall where each individual liner must hang from before filling bathtub with water. The unsecured liner and hooks increase safety hazard, and installation costs.

OBJECTS AND ADVANTAGES

With the foregoing in mind, this invention provides an improved, more efficient, disposable liner for the bathtub and shower with a non-slip surface that is removed in a novel peel away process, stripping off thin, flimsy, sheer, liquid impervious film layers. The final, mat-like, layer in contact with bathtub or shower has a thickness and softness that provides cushioned comfort.

This bottom layer is attached adhesively to the bathtub bottom, sides, ends, and top. The entire layer ensemble is compressed into a single, flexible, impervious liner, herein referred to as the chaise-liner. It is contoured to cover all bathtub and shower surfaces the bather may be in contact with, thereby establishing a low cost contamination prevention system. Dirt and bacteria are removed in flimsy, disposable, film sheers. Each new plastic film sheer is biologically clean and sterile, thereby eliminating time and effort necessary to clean, disinfect, and sterilize after each bath.

This resolves all the cleaning requirements associated with the prior art. The novel, peel away, disposable, film sheer becomes a particularly suitable and desirable feature for family households, hotels, motels, retirement homes, nursing homes, hospitals, public and private health clubs.

Accordingly, several objects and advantages of this invention are primarily the provision of a more efficient, practical, comfortable, sterile, contoured, and uniquely disposable chaise-liner for the bathtub and shower.

A further object of the invention is the provision of a chaise liner that is a combination of the character indicated above, wherein the top portion consist of layers of thin, flimsy, clingy, plastic film sheers (such as the material used to wrap and preserve foods). The layers are pressed compactly together into a single ensemble, with a means for bonding to bottom layer.

A further object of the invention is the provision to uniquely remove each layer (film sheer) from the surface of the chaise-liner, wherein each plastic film sheer is individually peeled off, serving also to strip away with ease all accumulated dirt and bacteria.

A further object of the invention is the provision of an improved non-slip surface, wherein slip-protection exists over the entire surface of each plastic film sheer, which extends over top edges and sides, increasing access and exit safety.

A further object of the invention is the provision of a low cost contamination prevention system, wherein each flimsy, disposable, plastic film sheer is water-tight, non-toxic, and sterile, such that the removal of a used plastic film sheer leaves a new, clean, sterile surface.

A further object of the invention is a provision of contoured, plastic film sheers, wherein each film sheer conforms to the shape of bathtub or shower basins, including sides, ends, and top edges of varying bathtub shapes and sizes.

A further object of the invention is the provision of a means to cling or bond each film sheer to those layers in contact directly above and below each other within the film stack, wherein the means to cling obviates a bond or adhesive need between the plastic film layers.

A further object of the invention is the provision of a comfortable, efficient bathtub and shower chaise-liner comprised of a top portion consisting of layers of thin, flimsy, clingy, plastic film sheers and a bottom supporting layer of thin, soft compressible material for cushion (such as foam rubber, impermeable bubble-plastic, plastic foam), wherein the bottom layer mat may consists of the same plastic material as top portion but with greater thickness, and a means for compressible softness.

A further object of the invention is the provision of an improved, novel means to affix or secure the chaise-liner in the bathtub or shower to be non-shifting relative to the tub or shower basin, including tub sides, ends and top surfaces, wherein the liner bottom (mat layer) is secured by light adhesive means to allow mat-like layer to be peeled away from tub or shower basin with relative ease.

A further object of the invention is the provision of a bathtub chaise-liner of the character indicated above, wherein the compressed liner has a means for translucence, color tints, and embossed designs that renders the chaise-liner attractive and decorative.

A further object of the invention is the provision of a means for packaging and storing, wherein individual chaise liners are folded and arranged directly for ease of installation in bathtub and shower.

A further object of the invention is the provision of a means for draining bath or shower water, wherein the drain hole in the liner is made to overlie bathtub or shower drain. The liner drain hole maintains an impervious seal through all the layers of the chaise-liner.

A further object of the invention is the provision of drain plugs or stopper pads used to stop water from draining while filling bathtub, wherein each stopper pad (one for each film sheer) is secured adhesively over the liner drain hole.

Further objects and advantages of my invention will become apparent from a consideration of the drawings and ensuing description of it.

BRIEF SUMMARY OF INVENTION

In accordance with the features of the invention, is a thin, flexible, plastic lining, having novel disposability, contamination prevention, non-slip safety, contoured design, and cushioned comfort, where the entire liner fits together removably in a bathtub or shower. This unique combination of liner features introduces it to common households, hotels, motels, and medical communities. Installation, cleaning, use, and removal are made simple through combined improvements.

In principle, the invention is a thin multi-layered liner for the bathtub and shower, comprised of flimsy, contoured, plastic film sheers compressed together, with a thick, mat-like sheet added to the bottom forming a single, flexible, liner.

It is placed in the bathtub basin covering all the tub surfaces, including both ends, sides, and top edges, with some overlap on access side. It is removed completely through the process of peeling, where thin, film sheers, are individually peeled from the top, down to the bottom mat-like sheet, which is peeled away from the bathtub surfaces. The liner bottom sheet has a means for a thin adhesive (such as label adhesive for smooth surfaces) that covers the entire underside, which secures the liner fully to bathtub surfaces and allows removal through peeling.

Peeling can be accomplished by means of tabs, attached to each plastic film, which are pulled individually to cause the top film sheer to separate and peel. This removal process, simultaneously, strips away all accumulated dirt and bacteria, presenting a new, clean, sterile, layer surface.

Each disposable, film sheer is water-tight and non-toxic as a means to protect against transmission of infection and disease. Also, liner stopper pads, which are thin, round, flexible, sterile, plastic drain covers provide a further means of protection against contamination. Each disposable stopper pad has a means for adhesive backing which secures it over drain hole in liner. The stopper pad is removed by a tab means, where the tab extension is pulled back to allow water to drain. After removing the stopper pad, the soiled film sheer is peeled away, and crumpled for easy disposal.

DETAILED DESCRIPTION OF THE INVENTION

The invention is a device constructed to be placed into the interior of various size bathtubs and showers, which will provide a protective, non-slip, sterile, disposable lining for the interior surfaces of the bathtub and shower.

Figure 1:
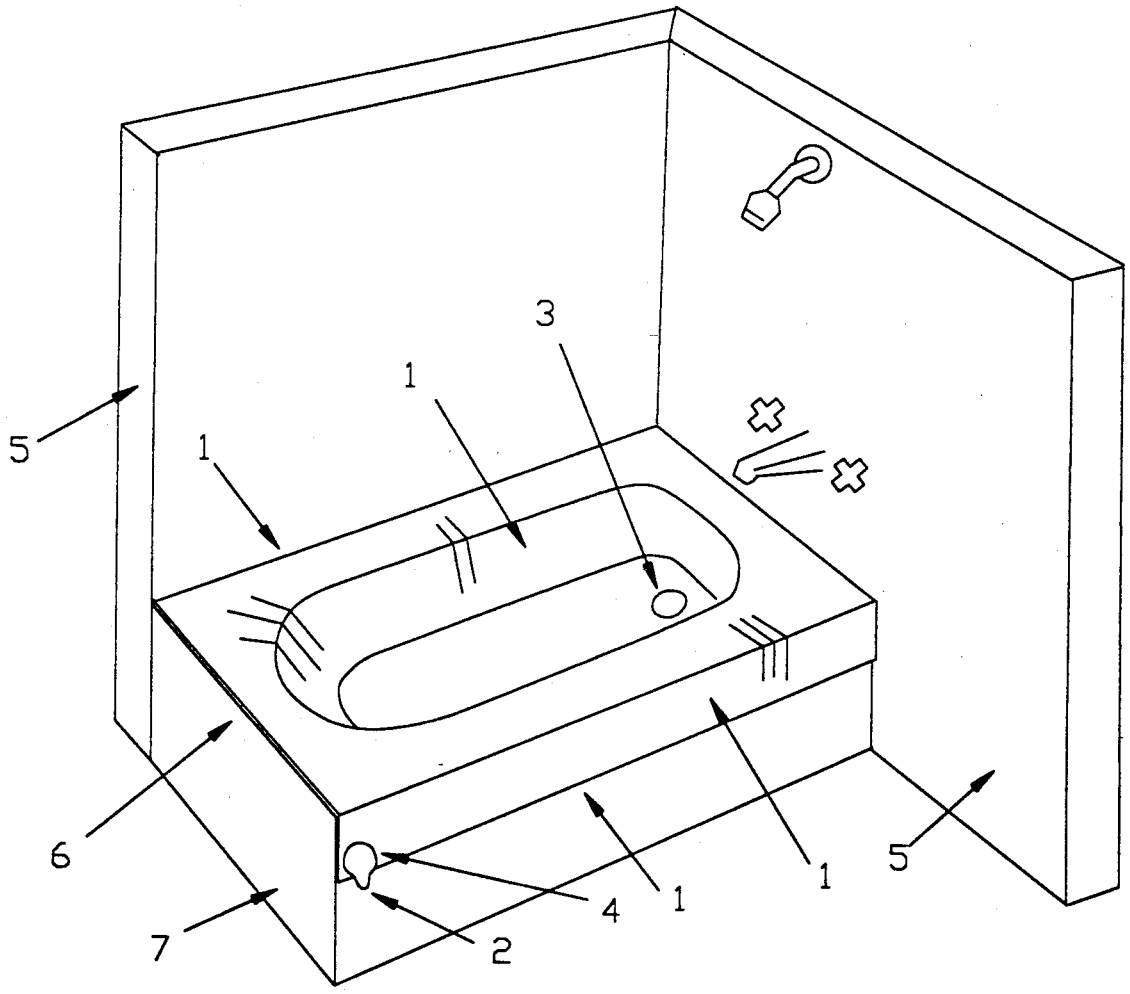
FIG. 1 is a perspective view of the bathtub liner in place inside a conventional tub and shower.
Figure 5:
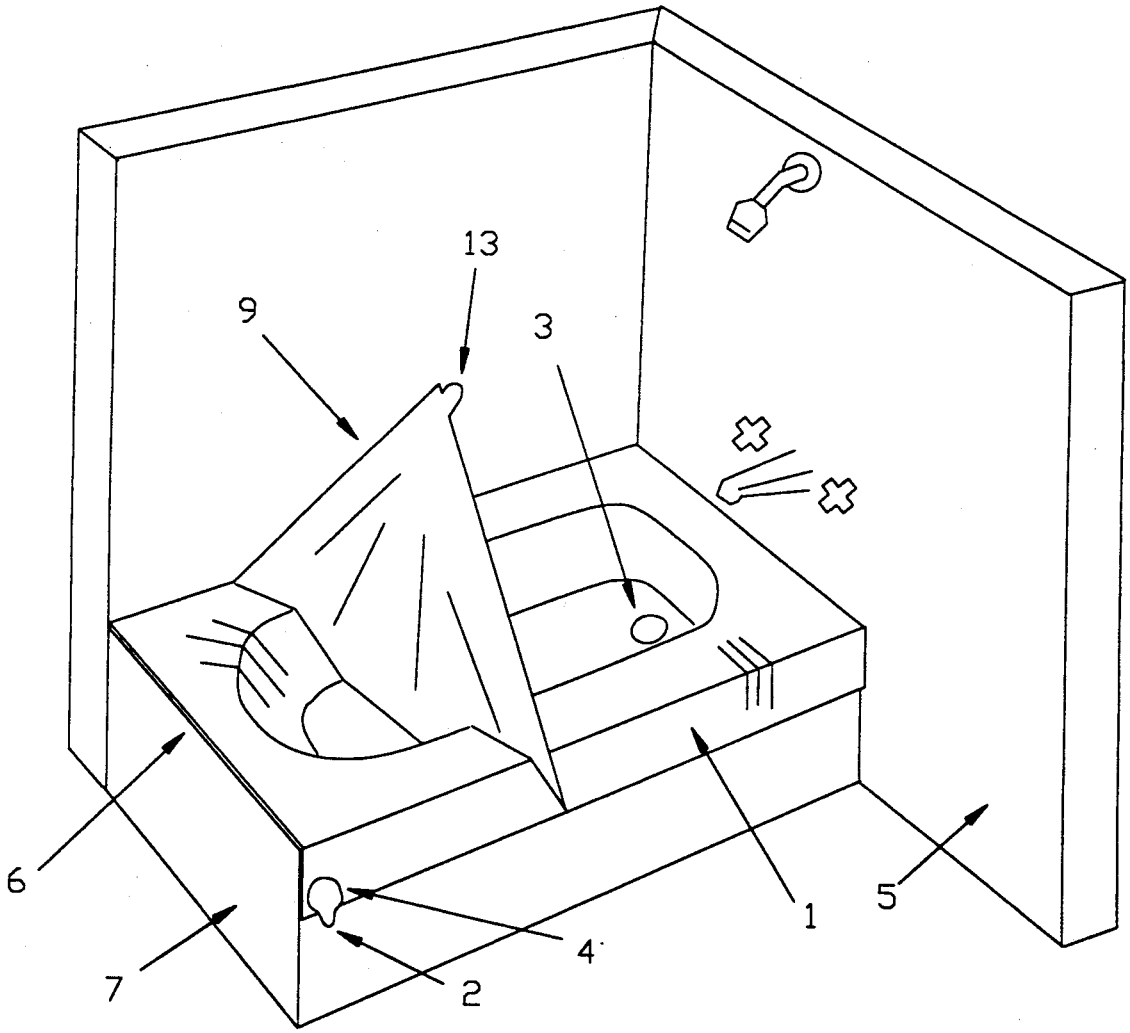
FIG. 5 is a perspective view of the bathtub liner in place inside a conventional tub and shower, showing a film sheer being lifted and peeled off the top surface.

With reference now to FIG. 1, the liner 1 is shown as it would appear within a conventional bathing facility such as bathtub 7 with shower head on vertical end wall 5. The liner 1 is contoured to fit removably in bathtub 7 bottom, two sides, vertical one end, and the sloping other end. Liner drain 3 is covered using stopper pad 4 when filling bathtub 7 with water. Bath water is drained by lifting stopper tab extension 2 to remove the stopper pad 4 from liner drain hole 3. Dirt and bacteria are removed by peeling off film sheer 9, as indicated in FIG. 5, and introduces a new film sheer as top surface. Referring back to FIG. 1, liner 1 consists of several film sheers and a mat layer attached together forming a single liner ensemble 6, which is secured to surface of bathtub 7 and shower basin.

Figure 2:
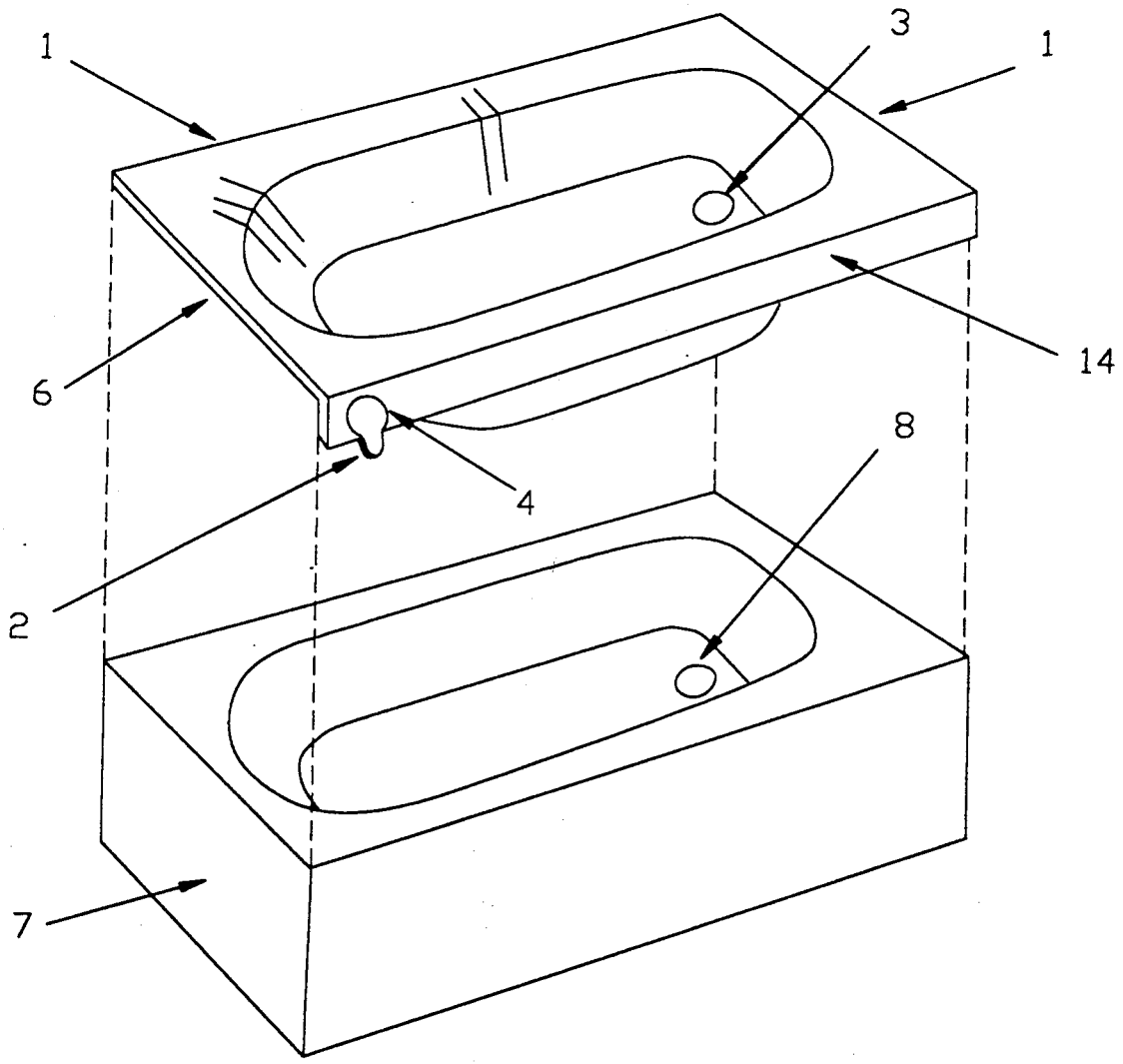
FIG. 2 is a stand alone perspective view of a standard or conventional bathtub showing the improved liner of this invention in a raised relationship above the bathtub.

Referring now to FIG. 2, as indicated by the phantom lines, liner 1 is shown above bathtub 7 intact and compressed together with thickness 6 shown. Stopper pads 4 and tab 2 extensions are shown as attached to liner 1. Installation of liner 1 begins with alignment of liner drain hole 3 and tub drain hole 8 located at vertical end of bathtub 7, extending liner 1 over bathtub 7 and shower basin sides, ends, and top surfaces including overlap 14 on access side shown in FIG. 1.

Figure 3:
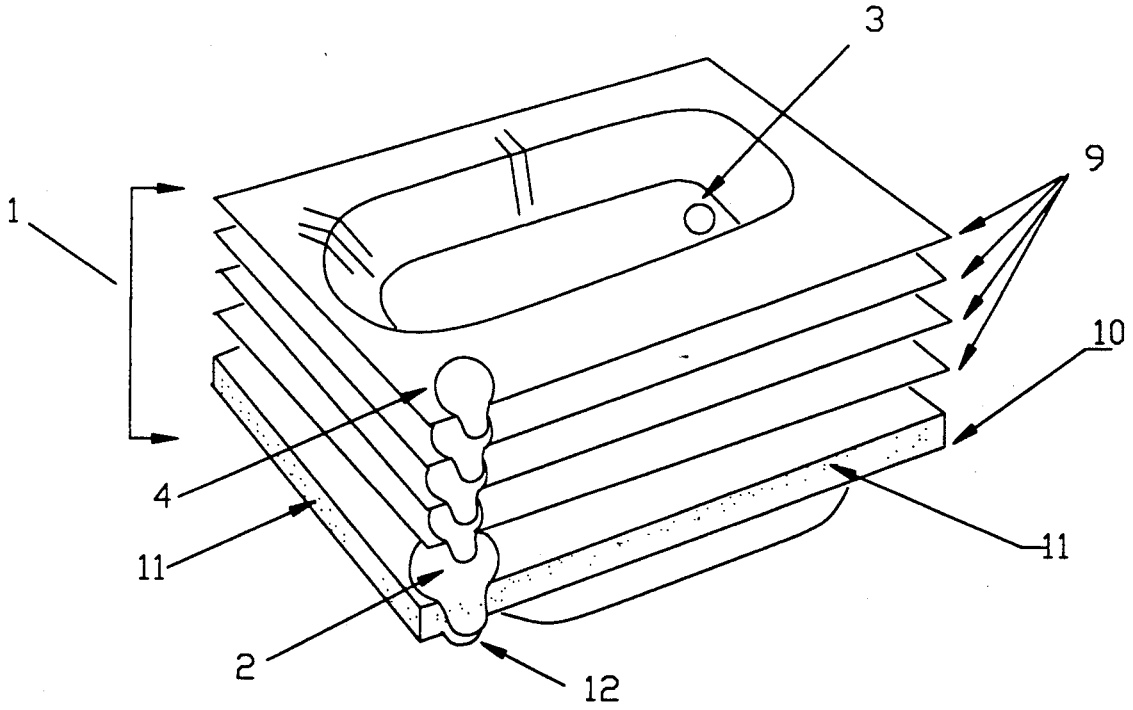
FIG. 3 is an enlarged perspective view of the improved liner assembly of this invention exploded into separate parts.

As shown in FIG. 3, an expanded and exploded view shows separate aspects of invention apart from bathtub shown in FIG. 1 and FIG. 2. Liner 1 is comprised of many film sheers 9 and a mat-like sheet 10 of greater thickness. Each film sheer 9 is a thin, flimsy, sheet of plastic similar to material used to wrap and preserve foods. Liner drain hole 3 is continuous through all film sheers 9 including the mat sheet 10 made of compressible material 11 which is removed by lifting tab 12. Liner drain hole 3 is made through the entire liner ensemble 1, which acts to seal the layers at the liner hole 3 indicated in FIG. 2.

Figure 4:
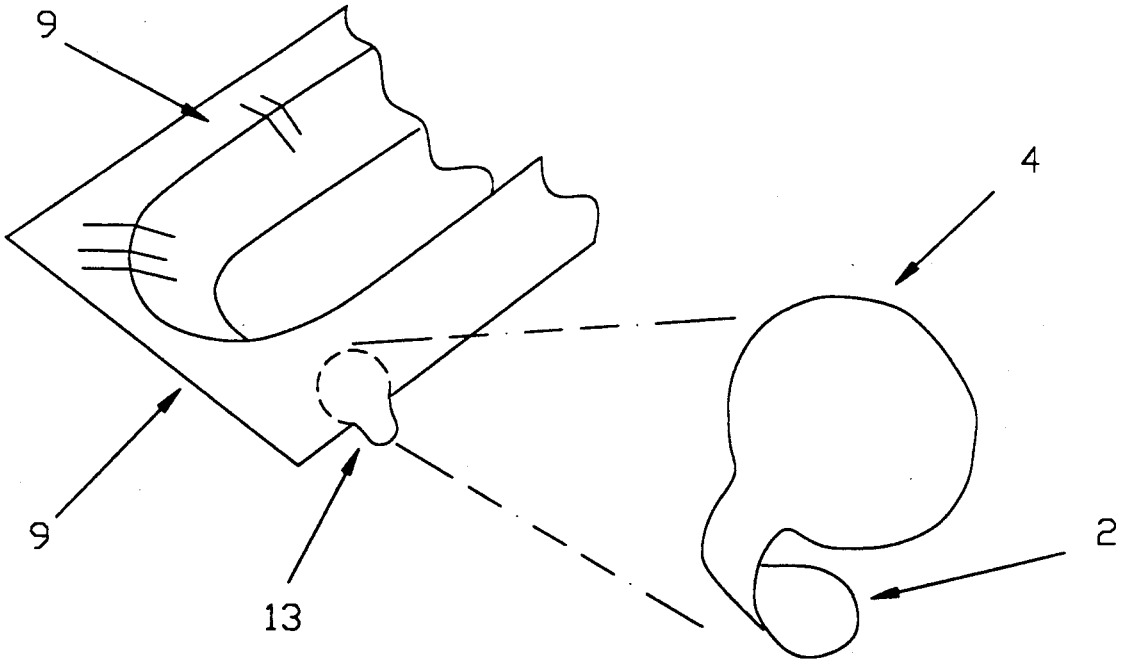
FIG. 4 is a fragmentary view of an individual film sheer of the improved liner showing an expanded view of the stopper pad being peeled away from attached film sheer.

With reference now to FIG. 4, the strategic placement of the stopper pad 4 shows how removing it is accomplished by peeling it from the individual film sheer 9. The separated stopper pad 4 reveals the tab 13 attached to the film sheer 9 that is used to lift and peel away the top surface sheet, as indicated in FIG. 5. Each film sheer 9 has its own tab 13 extension located at the corner, which is aligned uniformily with the stopper pad 4 tab extension 2.

Referring now to FIG. 5, is the illustration of peeling a film sheer 9 from the liner ensemble 6 surface. The film tab extension 13 is lifted, separating the film sheer 9 from the liner 1 and peeling it away leaving a new, clean, sterile liner surface.

The bathtub and shower liner of the subject invention provides therefore for a comfortable, sanitary environment, as well as the convenience of peeling away dirt and bacteria making cleaning and disposability fast and easy.

CONCLUSIONS, RAMIFICATIONS, CLAIMS

While the invention has been described with reference to a particular set of drawings, it will be understood by those skilled in the art that various modifications may be made to allow adaptation of situations or materials to the teachings of the invention while remaining within the scope thereof.

Therefore, it is intended that the invention not be limited to the particular embodiment disclosed, but that the protection sought be limited only by the terms of the claims which follow.

We claim:

1. A liner for use with a bathing facility having a drain, said liner comprising:

a plurality of disposable, flimsy, contoured, watertight, non-slip, non-toxic, sterile, plastic film sheers all compressed to form a single liner ensemble; said ensemble being attached to a disposable, contoured, sterile, cushioned mat-like bottom sheet, said bottom sheet having a thin adhesive covering on the underside thereof so as to secure said bottom sheet to surfaces of said bathing facility;

said film sheers each being removable from said ensemble by peeling said film sheers one at a time from top to bottom of said ensemble by utilizing a tab attached to each plastic film sheer;

each said film sheer and said mat-like bottom sheet having a drawn hole therethrough to overlie said facility drain;

a disposable, thin, flexible, sterile plastic drain stopper pad attached to each film sheer;

each stopper pad comprising a round portion having an extension tab, each extension tab being supperimposed on said tab of said film sheer and attached thereto by a light adhesive;

wherein with said ensemble and bottom sheet attached to said bathing facility said stopper pad is removed from said film sheer and placed over said drain hole so as to provide a bathing fluid impervious lining over said bathing facility and after the bathing process said stopper pad is removed from said drain hole by pulling said extension tab to allow said fluid to exit via said drain after which said sheer is removed from said ensemble by lifting its tab.

* * * * *

UNITED STATES PATENT AND TRADEMARK OFFICE

CERTIFICATE OF CORRECTION

PATENT NO. : 5,216,764

DATED : June 8, 1993

INVENTOR(S) : Horace Hall and Vivian E. Lacy

It is certified that error appears in the above-indentified patent and that said Letters Patent is hereby corrected as shown below:

On the title page, item [57], after "contoured," insert --liquid,--.

Column 6, line 8, change "drawn" to --drain--.

Signed and Sealed this

Seventeenth Day of January, 1995

*Attest:*

*Attesting Officer*

BRUCE LEHMAN

*Commissioner of Patents and Trademarks*